US005248429A

United States Patent [19]

Larsen

[11] Patent Number: 5,248,429

[45] Date of Patent: Sep. 28, 1993

[54] METHOD AND SYSTEM FOR TRANSFERRING MATERIALS

[75] Inventor: Bjørn E. H. Larsen, Køge, Denmark

[73] Assignee: Sun Chemical Corporation, Fort Lee, N.J.

[21] Appl. No.: 810,502

[22] Filed: Dec. 19, 1991

[51] Int. Cl.[5] ..... B65F 7/00

[52] U.S. Cl. ..... 210/767; 141/7; 141/8; 141/65; 141/114; 141/314; 220/403; 220/404

[58] Field of Search ..... 222/1, 527, 528, 529; 141/1, 7, 8, 65, 91, 114, 313, 314; 210/767, 808; 137/12; 220/402, 403, 404, 908; 446/202, 220; 55/1

[56] References Cited

U.S. PATENT DOCUMENTS

| | | | |
|---|---|---|---|
| 2,177,919 | 10/1939 | Vogt | 141/114 |
| 3,330,448 | 7/1967 | Murphy | 222/529 |
| 4,579,826 | 4/1986 | Bolton et al. | 446/202 |
| 4,767,035 | 8/1988 | Jacobi | 222/527 |
| 4,844,286 | 7/1989 | Jacobson | 220/403 |
| 4,878,600 | 11/1989 | Derby | 222/527 |
| 5,059,084 | 10/1991 | Krein | 220/403 |
| 5,154,308 | 10/1992 | Larson | 220/403 |

FOREIGN PATENT DOCUMENTS

| | | | |
|---|---|---|---|
| 420422 | 3/1991 | European Pat. Off. | 141/114 |
| 2219751A | 12/1989 | United Kingdom | 446/220 |

*Primary Examiner*—Joseph W. Drodge
*Attorney, Agent, or Firm*—Jack Matalon

[57] ABSTRACT

A method and system for transferring a flowable material from a container to a receiver through a flexible tubing which communicates with an opening defined in the container and which extends outwardly from the container. The method involves establishing within the container, after discharge of the material therefrom, a pressure less than the ambient pressure so as to draw the tubing into the container through the opening as a result of the pressure differential created between that within the container and the ambient pressure.

24 Claims, 4 Drawing Sheets

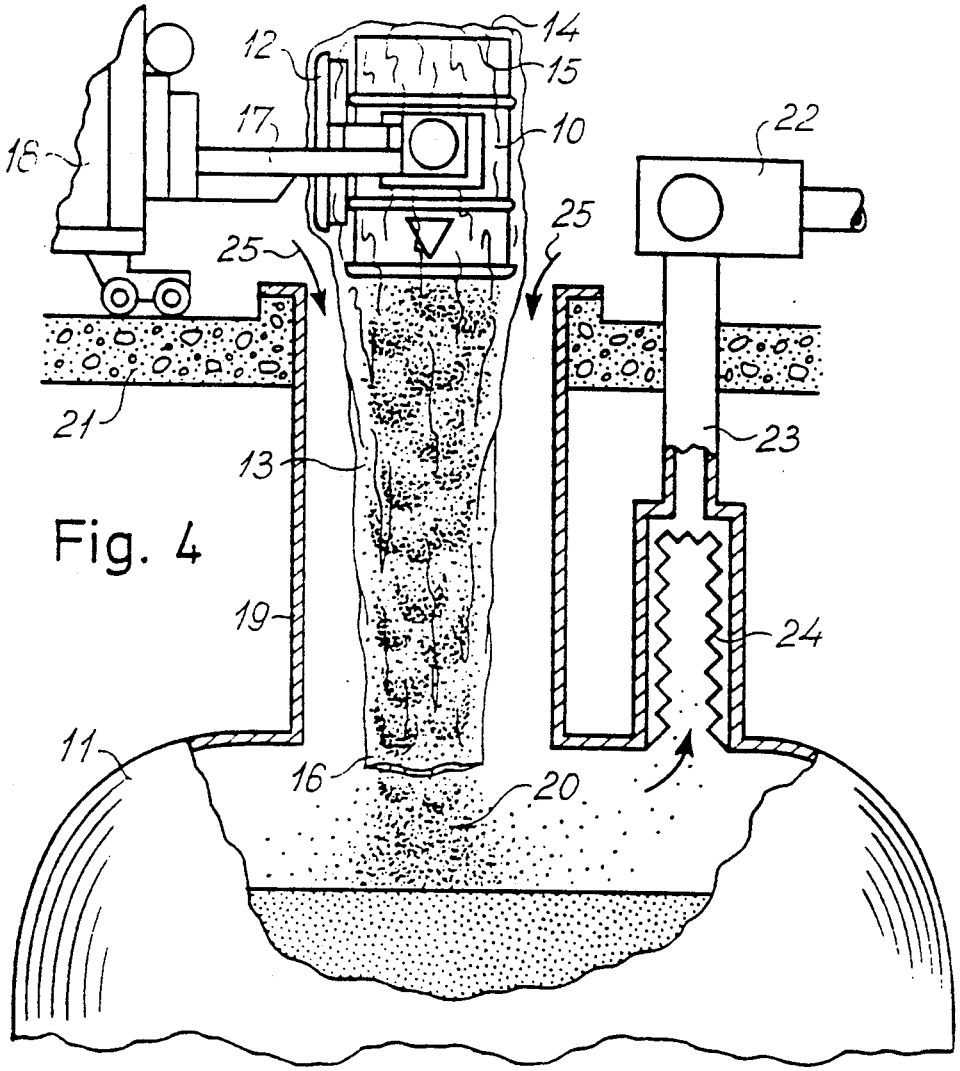
Fig. 4
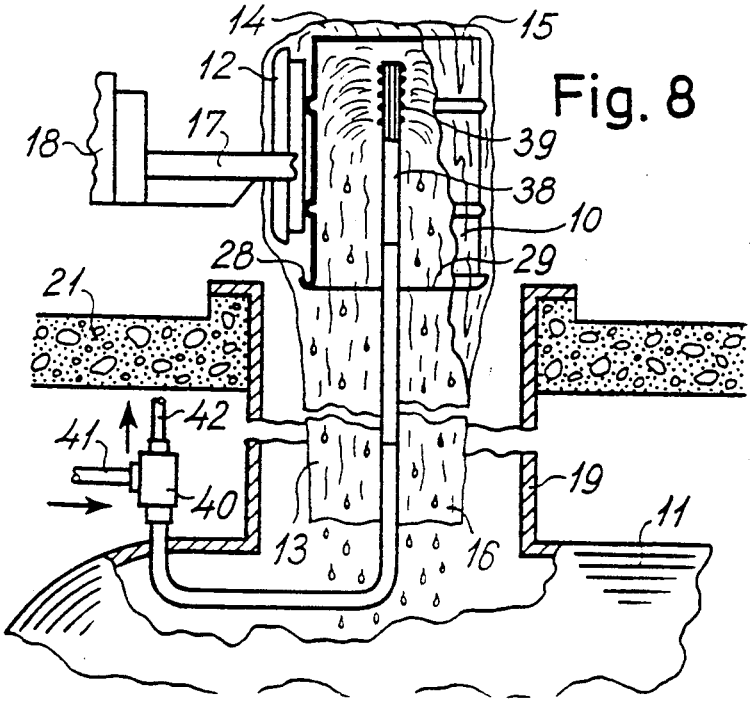
Fig. 8
Fig. 7
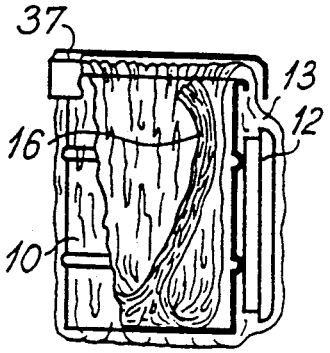

METHOD AND SYSTEM FOR TRANSFERRING MATERIALS

FIELD OF THE INVENTION

The invention relates to a method and system for transferring a flowable material from a container to a receiver. The method and system are particularly suitable for the transfer of hazardous powdered, particulate or liquid materials.

BACKGROUND OF THE INVENTION

When hazardous materials (e.g. powders, particulates or liquids) are shipped in drums, barrels, packages, containers, etc., it is necessary to take special precautions in order to prevent pollution of the environment and/or health risks in the course of transferral of the material from its container to a receiver such as another container or vessel, e.g. reactor vessel, in which the material is to be stored or used. Moreover, the emptied containers must thereafter be disposed of in an acceptable manner.

EP-A2-0420422 discloses a herbicide container having a rigid outer casing accommodating an inner liner. After such container has been emptied, the inner liner is removed from the container, air is expelled therefrom and the liner is then placed in a waste receptacle. The outer casing is separately disposed of and, when the waste receptacle is filled with liners, it is disposed of in its entirety. In the course of removal of the liner from the outer casing and expelling of air from the liner, there is a possibility of herbicide residues being concurrently expelled from the liner and discharged into the atmosphere. In addition, the requisite handling of the empty container poses a significant health risk to the persons handling the emptied containers.

The present method and system provides for a means whereby a flowable material may be readily transferred from a container into a receiver in a safe and environmentally acceptable manner.

SUMMARY OF THE INVENTION

The present invention provides for a method of transferring a flowable material from a container to a receiver through a flexible tubing which communicates with an opening defined in the container and which extends outwardly from the container, by establishing within the container, after discharge of the material therefrom, a pressure less than the ambient pressure so as to draw the tubing into the container through said opening as a result of the pressure differential created between that within the container and the ambient pressure.

Inasmuch as the material flows out from the container through the tubing, even a powdered material is transferred in a concentrated, solid stream which may be directed to the receiver. As a result, the tendency of particles of the material to enter the atmosphere is significantly reduced.

After the material has discharged from the container, the tubing is drawn into the container as a result of the pressure differential, since the outer open end of the tubing will collapse and thereby close the opening of the tubing. Due to its inherent rigidity, or by providing such rigidity by other auxiliary means, the container is prevented from collapsing while the tubing is drawn into the container. Thus, those surfaces of the container which have been in contact with the material will not be exposed to the atmosphere and will be positioned within the container. Accordingly, the emptied container may then be readily disposed of without attendant health and/or environmental risks.

The flowable material may be transferred from the container to the receiver by any suitable method, e.g. by means of a suction tube which is introduced through the flexible tubing. Preferably, the material is transferred from the container to the receiver solely under the influence of gravity, i.e. the container is inverted and positioned above the receiver such that its opening is directed downwardly toward the receiver.

The container opening may be defined in the container by removing a removable wall part, e.g. a cover or lid, whereupon the container may be inverted as described above.

The flexible tubing may be made from any suitable flexible material, e.g. paper, fabric, plastic, rubber, metal, etc. Preferably, the tubing is made from plastic film, desirably of a type which is not likely to generate static electricity. Suitable plastic materials include high- and low-density polyethylene, polypropylene, polyvinyl chloride, polyesters, etc. The material from which the tubing is made should not be penetrable by the contents transferred therethrough and preferably should also be gas- and/or liquid-tight.

The tubing may be connected to the container during the manufacture of the container. Alternatively, the tubing may be arranged on, and connected to, the container immediately prior to discharging the contents of the container. Thus when the container comprises at least one side wall (a barrel or drum of course has only a single, continuously-curved side wall) and opposite end walls, the tubing may be arranged around the side walls and the opening may be located in one of the end walls thereof. One end of the tubing may then be affixed to the side walls of the container by conventional means, e.g. heat welding, adhesives, etc.

The inner surface of the removable wall part of the container, e.g. the cover or lid, will generally have been in contact with the contents of the container. Accordingly, when such wall part has been removed from the container opening, it is preferentially arranged in a space defined between the side walls of the container and the tubing, such that one who opens and/or empties the container need not come into contact with such wall part.

In a preferred embodiment, the container is placed in a bag which is open at one end, and the open end part of the bag may then form the tubing. In such case, the tubing need not be affixed to the side walls of the container.

The length of the tubing extending from the container opening preferably is of sufficient length to insure that the flowable material being discharged from the container is safely directed into the receiver. Thus, the axial length of the tubing extending outwardly from the container is preferably in the range of about 2 to 3.5 times the axial length of the container. It is, of course, possible to insert a collapsed end portion of the tubing in the container by mechanical means, if necessary, e.g. the collapsed end portion of the tubing may be rolled up or pushed into the container by suitable mechanical means.

The tubing may be provided with at least one annular part, relatively stiff in nature, having outer dimensions exceeding the dimensions of the container opening so as to form one or more abutment surfaces on the annular part. Preferably, the spacing between the container opening and the adjacent annular part as well as each mutual spacing of adjacent annular parts should not exceed about twice the axial length of the inner space of the container when the tubing is in an axially extended condition. When the tubing is provided with such spaced abutment surfaces, the tubing may be drawn into the inner space of the container as a result of the pressure differential even in the case of relatively long tubing, since the tubing will be drawn into the container in a telescopic manner.

Residual material remaining in the container after discharge of the contents therefrom may be readily flushed out from the inner space of the container by means of a flow of a fluid flushing medium (e.g. a liquid or gas) directed into said container prior to creating said pressure differential. The flushing medium and entrained residual material may then flow out of the container through the tubing.

The pressure differential required in order to cause the tubing to be drawn into the inner space of the container may be provided by increasing the pressure in the space around the container. In a preferred embodiment, however, the pressure differential is created by establishing a pressure of less than ambient pressure within the container by withdrawing gas (e.g. air) from the inner space of the container. Such withdrawal of the gas may be accomplished by means of an evacuation tube extending axially through the inner space of the tubing. The evacuation tube may be stationary, and the tubing may be lowered around the stationary evacuation tube. Alternatively, the evacuation tube may have a pointed end and be inserted through the wall of the tubing adjacent to the container opening. In any event, the free end of the evacuation tube at which the suction tube is defined is preferably positioned sufficiently close to the container wall part disposed opposite the container opening so as to draw the tubing into the container and close to such opposite container wall part.

In another embodiment, the evacuation tube punctures, and is inserted through, a wall part of the container disposed opposite the container opening, e.g. the bottom end wall of the container. When the container is constructed of metal or other rigid material, the opening may be preformed in the wall part of the container, and the evacuation tube may be inserted through the preformed opening, which may be closed, e.g. by a membrane constructed of plastic, rubber or other readily-penetrable material. In the case where the tubing is formed by the free end portion of a bag-shaped inner liner of the container, the preformed opening may be closed by suitable mechanical closure means, e.g. lid, slide, etc. For example, the bottom end wall part of the container may be formed by a removable lid or cover which may be removed immediately prior to puncture of the adjacent part of the inner liner by the evacuation tube. Alternatively, a wall part, e.g. the bottom end, may be constructed so as to be pervious to air (or a gas), but impervious to the flowable material within the container. Air (or a gas) may then be evacuated from the container through such pervious wall part.

A tube assembly comprising a flushing tube and the evacuation tube may be inserted in the inner space of the container as described above in respect to the evacuation tube. When a flushing medium has been expelled through the flushing tube, the evacuation tube may be operated so as to withdraw air (or a gas) from the inner space of the container, thereby causing the flushed tubing to be drawn into such inner space.

The tubing may be constructed from a heat shrinkable material (e.g. plastic film) and in such case, the tubing may be exposed to heat sufficient to shrink the material prior to or concurrent with the establishment of the pressure differential between the ambient atmosphere and the inner space of the container.

The emptied container in which the tubing has been arranged as described above may be closed by means of a fresh cover or lid member, whereby the inner space of the container may be completely closed off. Since none of the exposed surfaces of the thus-closed container have been in contact with the contents of the container which were transferred to the receiver, the empty container may be handled and disposed of without significant risk.

In order to reduce the risk of contaminating the atmosphere with the contents of the container being transferred from the container to the receiver, the pressure within the receiver is preferably maintained at a level of less than the ambient pressure so as to create an air flow around the tubing directed into the receiver.

Any residual flowable material remaining in the container after transfer thereof to the receiver may be flushed out from the inner space of the container by means of a flow of a fluid flushing medium directed into the container prior to creating the pressure differential. If desired, the fluid flushing medium which is withdrawn from the inner space of the container may be passed through a separating device so as to separate any particles entrained in such flushing medium, and the separated particles may then be passed from the separating device to the receiver.

According to a second aspect, the present invention provides a method for disposal of empty containers having an opening defined therein and having a tubing constructed from a flexible material which communicates with the opening and extends outwardly from the container. Such method involves establishing a pressure within the container of less than ambient pressure so as to draw the tubing into the container through the opening under the influence of the pressure differential, and thereafter disposing the container in an acceptable manner.

According to a third aspect, the present invention provides for a container for flowable materials. Such container has a wall part which may be removed so as to define an opening in the container, and the container also has a tubing having one end sealingly affixed to or in engagement with the wall surfaces encircling the container opening, and the tubing is arranged in a retracted, collapsed, inactive position.

When the flowable material is to be discharged from the container, an opening is defined in the container by removing the wall part which may be, e.g. a removable cover or lid. Thereafter, the tubing may be moved from its inactive position to an extended active position through which the flowable material may be discharged. The tubing may thereafter be drawn into the inner space of the container by establishing a pressure differential as described above.

The tubing may be affixed to or may be in engagement with the outer or inner surfaces of the container wall. In its inactive, collapsed position, the tubing may then form an annular ridge encircling the outer surface of the container wall, or be arranged inside the container adjacent to the container opening.

The invention will now be further described with reference to the accompanying drawings, wherein:

FIGS. 1–7 illustrate the steps of an embodiment of the method according to the present invention;

FIG. 8 illustrates a modified flushing step of the method according to the present invention;

Figure 17:
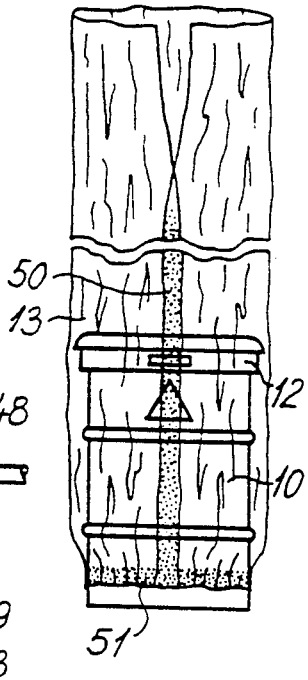
Figure 18:
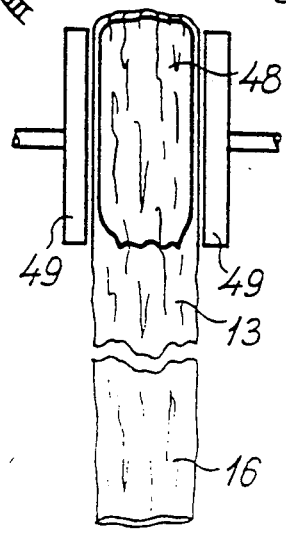

FIG. 17 illustrates an embodiment of the method according to the present invention wherein a web of plastic film is wrapped around a container and is thereafter converted into a tubular member and fastened to the outer surface of the container by adhesives or by heat sealing; and FIG. 18 illustrates an embodiment of the method according to the present invention wherein the container is constructed in the shape of a bag from a flexible material.

FIGS. 1–7 illustrate how a flowable, i.e. particulate or pulvurent, material which is hazardous to one's health and/or the environment may be safely discharged from a container 10 into a reactor vessel or receiver 11.

Figure 1:
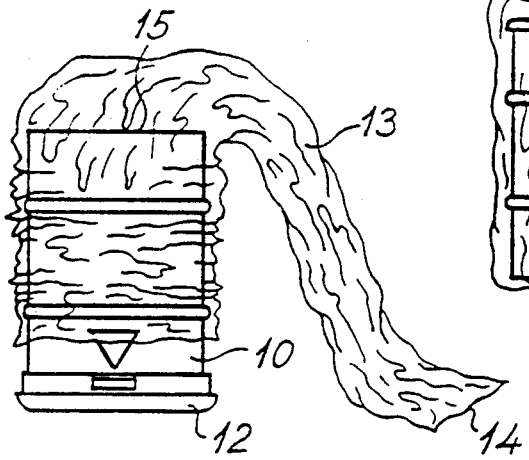
Figure 2:
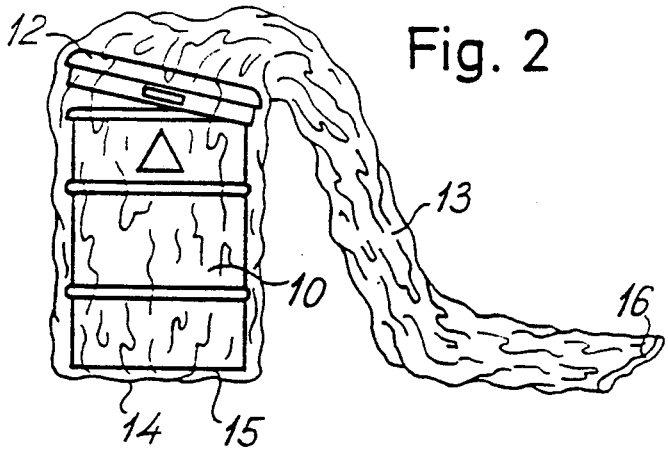

As may be seen in FIG. 1, container 10, which is closed by upper lid or cover 12 may be inverted, whereupon tubing 13, constructed from a flexible material and closed at one end 14, is drawn over the upwardly-directed bottom end 15 of container 10 so that the closed end 14 of the tubing 13 becomes positioned adjacent to bottom end 15 while the remaining part of tubing 13 surrounds the peripheral wall of the container in a collapsed condition. Container 10 may now be turned to an upright position such that lid 12 is directed upwardly, and tubing 13 may now be extended so that open end portion 16 extends beyond the upper end of container 10 by an amount substantially exceeding the height of the container. Preferably, the length of the portion of tubing 13 extending beyond the upper portion of container 10 closed by lid 12 is between about 2 to 3.5 times the axial length of container 10, most preferably about 3 times the axial length of container 10.

Figure 3:
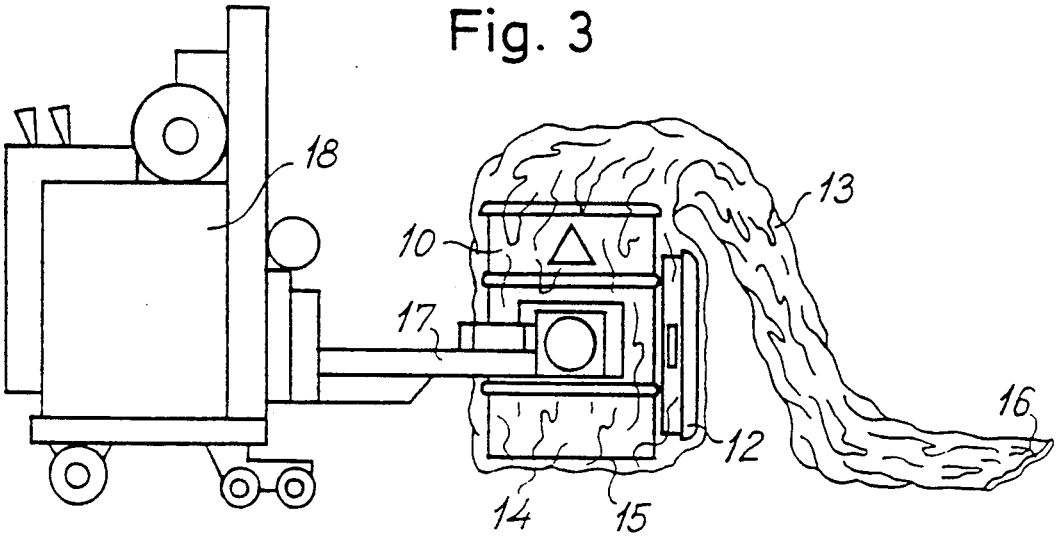

Container 10 may now be opened by removal of lid 12, which may thereafter be placed in the space defined between the outer peripheral wall of container 10 and surrounding tubing 13 as shown in FIG. 3. Lid 12 may be removed manually from container 10 and be placed between tubing 13 and container 10 by another person who need not come into contact with lid 12. Container 10 may then be gripped and lifted by arms 17 of wheeled lifting truck 18 (FIG. 3) by means of which container 10 with tubing 13 arranged thereon may be transported to chute opening 19 into reactor vessel 11 as shown in FIG. 4. In order to discharge flowable material 20 from container 10 into vessel 11, container 10, which is gripped by arms 17, may be rotated about a horizontal axis so as to position the container upside down with open end portion 16 of tubing 13 extending downwardly into chute 19 as shown in FIG. 4. Flowable material 20 in container 10 may now flow from container 10 into vessel 11 through tubing 13 exclusively under the influence of gravity. Open end portion 16 of tubing 13 extending beyond the container opening defines a flexible material discharge spout which significantly reduces the possibility of dispersion of particles or droplets of material 20 into the atmosphere.

As shown in FIG. 4, vessel 11 may be positioned below the level of floor 21 on which lifting truck 18 moves, and the inner space of vessel 11 may be connected to air pump or blower 22 via connecting tube 23 containing filter element 24. When pump or blower 22 is operating, air is drawn from vessel 11 so as to create a reduced pressure therein. This causes atmospheric air to flow into vessel 11 through an annular space defined between the inner walls of chute 19 and the outer walls of tubing 13 in the direction of arrows 25. Particles or droplets of material 20 entrained by the air discharged from vessel 11 by means of pump or blower 22 are retained by filter element 24.

Figure 5:
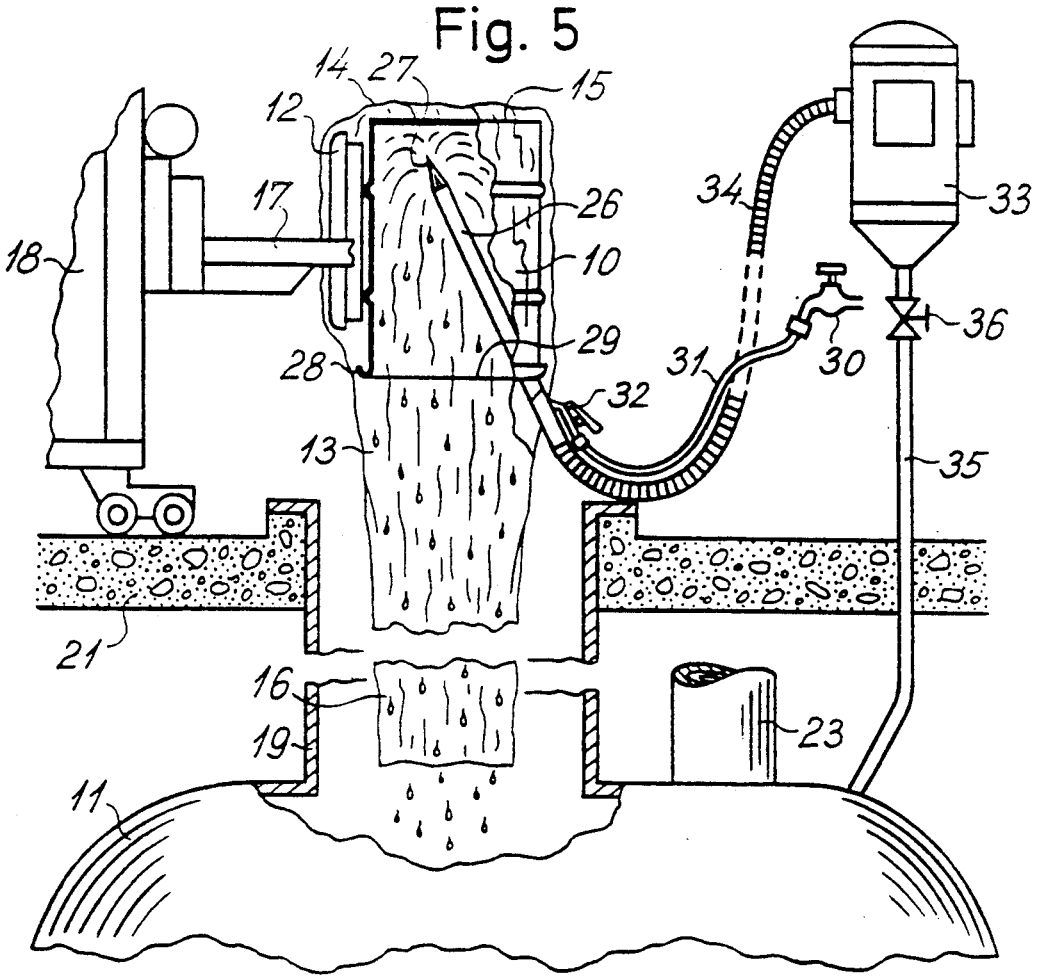

When substantially all of material 20 has been discharged from container 10, any residual material adhering to the walls of container 10 and/or the inner surfaces of tubing 13 may be flushed out with a flushing fluid (e.g. water or other suitable liquid) which may be sprayed into the inner space of container 10. As shown in FIG. 5, spraying device 26 having a pointed open end 27 may pierce the wall of tubing 13 at a position immediately adjacent to rim portion 28 of container 10 defining container opening 29. Pointed end 27 of spraying device 26 is preferably positioned adjacent to the inner surface of upwardly-directed bottom end 15 of container 10. The flushing medium may be supplied to spraying device 26 from water tap 30 or another source of liquid through flexible tube or hose 31 controlled by shut-off valve 32.

When the inner surfaces of container 10 and tubing 13 have been sufficiently flushed with the flushing medium which drains into vessel 11, the flushing operation may be terminated by closing valve 32. Suction openings defined at open end 27 of spraying device 26 communicates with liquid (or solid)/gas separator 33 via suction hose 34. Separator 33 communicates with a vacuum source, e.g. a vacuum pump, not shown, and liquid separated by separator 33 may flow into vessel 11 through tube or hose 35 containing shut-off valve 36.

After the flushing procedure has been terminated, the inner space of container 10 will be in communication with spraying device 26 and suction hose 34. When a reduced pressure has been established within container 10, the resultant pressure differential will cause collapse of end portion 16, thereby causing closure of the open end of tubing 13. Thereafter, end portion 16 is drawn into the inner space of container 10. Spraying device 26 may then be withdrawn from container 10, which may be returned to its normal upright position by means of lifting truck 18. After verifying that collapsed end portion 16 of tubing 13 is fully inserted into the inner space of container 10, container opening 29 may be closed with a fresh, uncontaminated lid or cover 37 as shown in FIG. 7. The closed, emptied container may then be disposed of in an acceptable manner.

Figure 6:
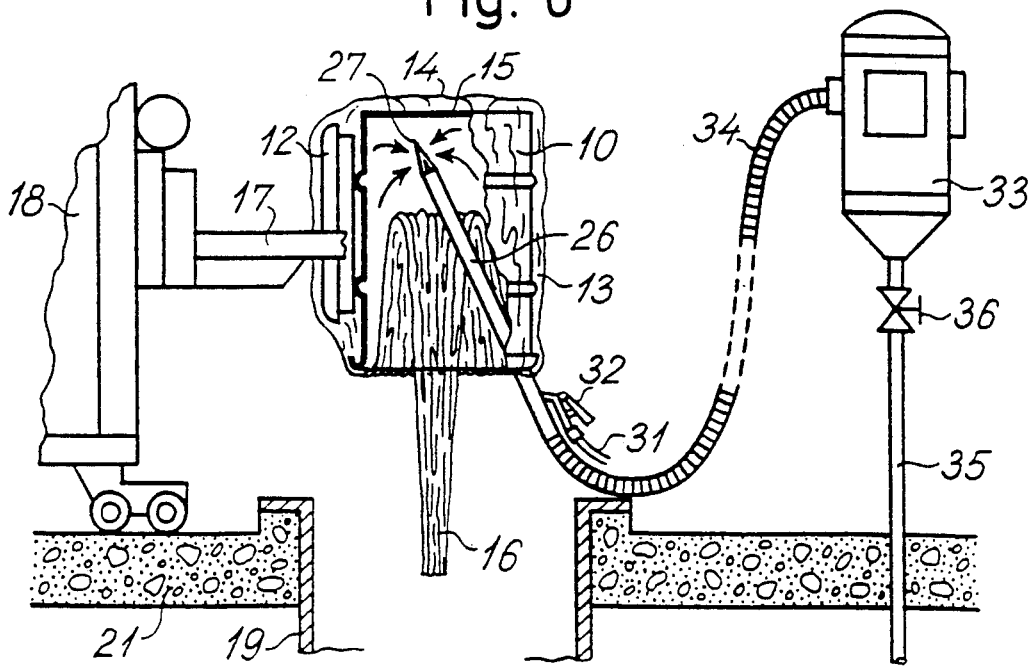

In the embodiment shown in FIGS. 5 and 6, spraying device 26 is moved and operated manually. Alternatively, spraying device 26 may be mounted and guided such that it may be moved between an extended tubingpiercing position and a retracted inactive position by mechanical moving means.

As shown in FIG. 8, spraying device 26 may be replaced with spraying/suction tube 38 arranged in a stationary position relative to vessel 11 and extending axially upwardly through chute 19. Tube 38 comprises a spraying and suction head 39 positioned at its free end, and the lower end of tube 38 is connected to 3-way valve 40 which is also connected to liquid supply conduit 41 and vacuum supply conduit 42. Conduit 41 may communicate with a water tap or another pressurized liquid source (not shown) and conduit 42 may be connected to a vacuum pump or other vacuum source (not shown).

When container 10 provided with tubing 13 is inverted to a position above chute 19 in order to discharge flowable material from container 10 into vessel 11, container 10 may be lowered axially in relation to tube 38 so as to position spraying and suction head 39 within the inner space of container 10 close to the bottom end 15 of container 10. After the flowable material has been discharged from container 10, tube 38 may communicate with conduit 41 via valve 40 whereby the inner surfaces of container 10 and open end portion 16 of tubing 13 may be flushed as previously described. Thereafter, valve 40 may be shifted to a position in which tube 38 communicates with conduit 42 so as to draw free end portion 16 of tubing 13 into the inner space of container 10 as shown in FIG. 6 and as described above.

Alternatively, tube 38 may be arranged axially displacable so that head 39 of tube 38 may be moved axially upwardly into the inner space of container 10 when container 10 has been positioned in its material-discharging position immediately above or within chute 19.

Tubing 13 described above in respect to FIGS. 1–8 is bag-shaped and has a closed end 14. However, tubing 13 may also be utilized as a tubular member having its opposite ends open. When one end portion of tubing 13 is drawn over the upper end of container 10, such end portion may be substantially tightly fastened to the outer peripheral surface of container 10 by suitable retaining means.

Figure 9:
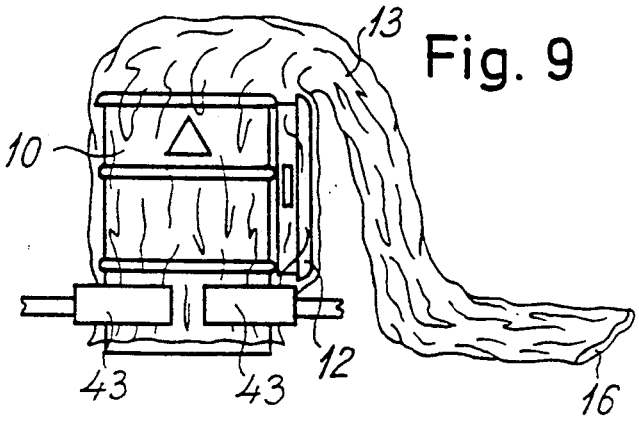

In FIG. 9, container 10 is gripped by a pair of opposite gripping members 43 which may be mounted on lifting truck 18 (not shown in FIG. 9). Gripping members 43 may be shaped such that they press the adjacent peripheral portions of tubing 13 into tight engagement with the outer surface of container 10.

Figure 10:
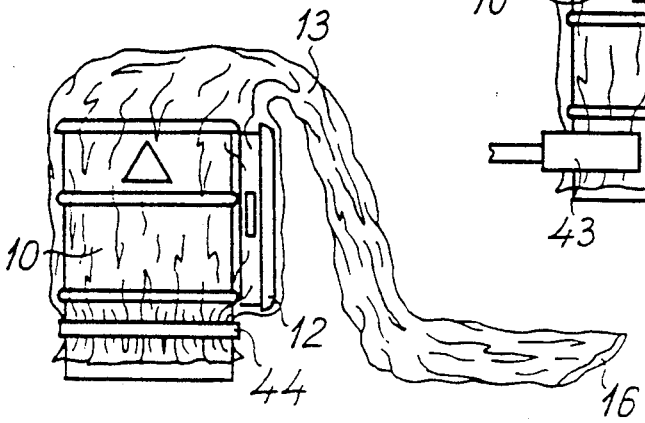
FIGS. 9 and 10 illustrate different means for fastening an open end of a tubing to the outer peripheral surface of a container.

In FIG. 10, tubing 13 is maintained in sealing engagement with the peripheral outer surface of container 10 by means of a belt or band 44, which may be, e.g. an elastic band. Belt or band 44 may be arranged in any axial position along the length of container 10.

Figure 11:
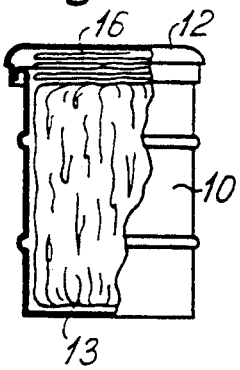
FIGS. 11 and 12 illustrate an embodiment of the container according to the invention which comprises a stiff outer drum and an inner bag-shaped lining.
Figure 12:
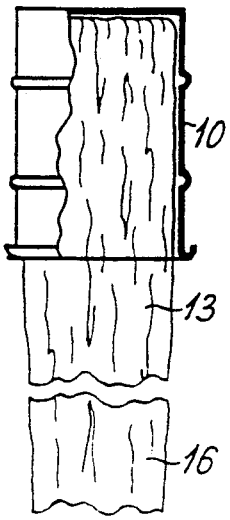

FIGS. 11 and 12 illustrate an embodiment according to the present invention in which an outer barrel-like container 10 having a lid 12 and an inner bag-like lining 13 enclosing the flowable material shipped in the container. When container 10 is filled with the particulate or pulverulent material, open end portion 16 of tubing 13 may be pleated or folded up in the upper inner space of container 10 immediately below lid or cover 12 as shown in FIG. 11.

Referring to FIG. 11, when container 10 is to be emptied, lid or cover 12, which is uncontaminated by the flowable material within bag-shaped lining 13, may now be removed without any problem. Thereafter, container 10 is inverted and its contents are discharged through open-end portion 16 of tubing 13 which now extends axially downwardly from container 10 as shown in FIG. 12. Tubing 13 is affixed to the inner end wall and inner side walls of container 10 in order to prevent tubing 13 from dropping out of container 10 when it is inverted and in order to maintain the inner end portion of tubing 13 in its extended position when a reduced pressure is established in container 10. Tubing 13 may be affixed to the walls of container 10 by various means, e.g. adhesives, heat sealing, or releasable mechanical means so that tubing 13 may be removed from container 10 and thereafter reused.

After tubing 13 has been flushed with a flushing fluid, e.g. water or other liquid, and has thereafter been drawn into the inner space of container 10 as previously described, lid or cover 12 may be re-positioned on container 10.

Figure 13:
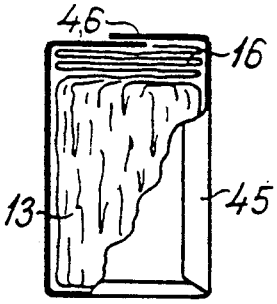
FIGS. 13 and 14 illustrate a container corresponding to that shown in FIGS. 11 and 12, wherein the outer cylindrical drum has been replaced by a parallelepiped-shaped box.
Figure 14:
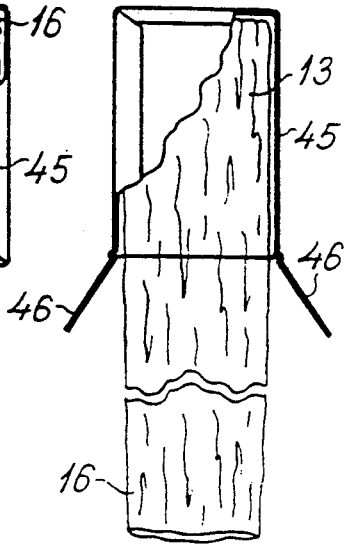

FIGS. 13 and 14 illustrate further a variation of container 10 shown in FIGS. 11 and 12. However, in FIGS. 13 and 14, the outer drum-like configuration has been replaced by parallelepiped-shaped container 45 constructed from cardboard or other similar material. Top wall 46 of container 45 is formed by foldable cover panels 46, which are glued, stapled, taped or otherwise interconnected in a closed condition such that they may be separated when container 45 is to be opened and the contents therein are to be discharged. After container 45 has been emptied and tubing 13 has been collapsed and moved into container 45, container 45 may be collapsed before proper disposal.

Figure 15:
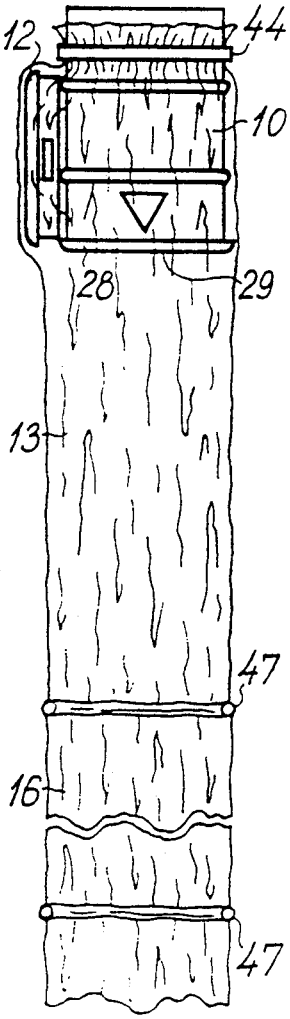
FIGS. 15 and 16 illustrate the steps of an embodiment of the method according to the present invention wherein the tubing comprises axially-spaced annular stiffening members.
Figure 16:
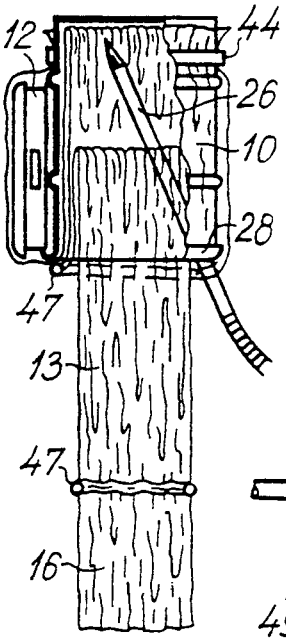

In order to avoid spillage or release of the flowable material to the atmosphere as it is being discharged from container 10, it is preferred that tubing 13 extend axially beyond container opening 29 along a substantial length. It is also desirable that substantially all of free end portion 16 of tubing 13 extending out from container 10 be capable of being drawn into the inner space of container 10 when the pressure in container 10 is reduced. Accordingly, the axial length of open end portion 16 extending from container 10 should preferably not exceed 3.5 times the axial length of container 10. However, if open end portion 16 of tubing 13 is provided with axially spaced, annular stiffening members 47 as shown in FIGS. 15 and 16, it is possible to draw a longer length of end portion 16 into the inner space of container 10 when the pressure is reduced therein.

The spacing between container opening 29 and adjacent stiffening member 47 as well as the mutual spacing of adjacent stiffening members should preferably not exceed 2 times the axial length or height of container 10. When a reduced pressure is established in the inner space of container 10, tubing 13 will be pleated in a telescopic manner inside container 10 as shown in FIG. 16 until the first stiffening member 47 engages with rim portion 28 of container 10, inasmuch as stiffening member 47 has a maximum diameter exceeding the inner diameter of container opening 29. Thereafter, a further length of tubing is drawn into the inner space of container 10 in a telescopic manner until the next stiffening member 47 comes into engagement with the first stiffening member, etc.

FIG. 18 illustrates a bag-like container 48 constructed from a flexible material, e.g. paper or plastic. Container 48 is arranged within tubing 13 which is affixed to the outer surface of container 48. When the contents of container 48 are to be transferred, the upper corner of container 48 is torn open. Thereafter, the container assembly comprising container 48 and tubing 13 affixed thereto may be gripped by means of a pair of opposite suction plates 49 and inverted above a receiver as previously described. Alternatively, tubing 13 may be defined by an integral free end portion of container 48. In the latter case, only the closed end portion of container 48 is maintained in its extended position, e.g. by means of suction plates 49 or by means of inner frame-like stiffening means, while the open end portion of container 48 is collapsed and drawn into the inner space of the extended end portion of container 48.

In the embodiments described above, tubing 13 has been constructed from a prefabricated tube member. Alternatively, a sheet of plastic film or other flexible sheet material may be formed into a tube around the outer peripheral wall of container 10 as shown in FIG. 17, and axially extending, overlapping edge portions of the sheet material may be interconnected in situ by an axial seam made, e.g. by gluing or heat sealing. Moreover, a free end portion of tubing 13 may then be connected to the outer peripheral surface of container 10 in any suitable manner, e.g. by means of a peripheral seam 51, which may also be made by gluing or heat sealing.

As is readily apparent, the method of the invention as described above allows a container 10 having a hazardous material to be opened, transfer of the hazardous material to a receiver 11 and closure and disposal of the emptied container without any risk of persons handling and emptying the container coming into contact with any surfaces of the container or tubing 13 which have been in contact with the hazardous material. Moreover, the flexible, free end portion 16 of tubing 13 substantially reduces the risk of particles or droplets of the hazardous material being dispersed into the atmosphere.

While a number of different embodiments of the method and system for transferring a flowable material from a container to a receiver according to the invention have been shown in the drawings and described above, such embodiments should not be interpreted as being exhaustive. Numerous modifications may be made within the scope of the present invention defined in the appended claims. The container which in accordance with the invention is provided with a tubing may be constructed from any conventional material, e.g. steel, plastic, cardboard, paper, wood, etc. including laminates of such material as well as fiber reinforced materials. The tubing may be constructed from any flexible sheet material, e.g. plastic film, rubber, metal foil, paper, fabric, etc., including laminates thereof and fiber reinforced sheet materials. Moreover, the container may be any shape desired, e.g. bottle-shaped with a neck defining an opening from which the tubing may extend.

What is claimed is:

1. A method of transferring a flowable material from an elongated container having a length along the axis of elongation having an inner space to a receiver through a flexible, collapsible tubing which communicates with an opening defined in the container which extends outwardly from the container and which has established dimensions, which comprises establishing within the container, after discharge of the material therefrom, a pressure less than the ambient pressure around the container so as to draw the tubing into the container through said opening as a result of the pressure differential created between that within the container and the ambient pressure, the axial length of the tubing extending outwardly from the container being in the range of about 2 to 3.5 times the axial length of the container before being drawn into the container.

2. The method according to claim 1, wherein the material is transferred from the container to the receiver solely under the influence of gravity.

3. The method according to claim 2, wherein the opening defined in the container is obtained by removing a removable upper wall part, and the container is inverted and positioned above the receiver.

4. The method according to claim 3, wherein the container comprises at least one side wall having an outer surface and an inner surface and opposite end walls and said collapsible tubing is disposed around the side wall and the opening is disposed in one of said end walls.

5. The method according to claim 4, wherein the collapsible tubing is sealingly disposed around the outer surface of the at least one side wall.

6. The method according to claim 4, wherein the collapsible tubing is sealingly disposed around the outer surface of the at least one side wall.

7. The method according to claim 3, wherein the upper wall part is disposed in a space defined between the at least one side wall and the collapsible tubing.

8. The method according to claim 1, wherein the collapsible tubing is provided with at least one annular part whose outer dimensions exceed the established dimensions of said container opening so as to form one or more abutment surfaces on said annular part.

9. The method according to claim 8, wherein the tubing contains a multiplicity of adjacent annular parts and a spacing is present between the container opening and the at least one annular part and the spacing between the opening and the at least annular part as well as each mutual spacing of adjacent annular parts does not exceed about twice the axial length of the inner space of the container when the collapsible tubing is in an axially extended condition.

10. The method according to claim 1, wherein the container is disposed within a bag open at one end, said open end portion of the bag forming said collapsible tubing.

11. The method according to claim 1, wherein any residual flowable material remaining in the container after transfer thereof to the receiver is flushed out from the inner space of the container by means of a flow of a fluid flushing medium directed into said container prior to creating said pressure differential.

12. The method according to claim 11, wherein the fluid flushing medium which is withdrawn from the inner space of the container is passed through a separating device so as to separate any particles entrained from said flushing medium, and the separate particles are passed from the separating device to the receiver.

13. The method according to claim 1, wherein the pressure less than the ambient pressure is established by withdrawing gas present in the inner space of the container.

14. The method according to claim 13, wherein the gas is withdrawn through an evacuation tube extending axially through the inner space of said collapsible tubing.

15. The method according to claim 13, wherein the gas is withdrawn through an evacuation tube inserted through the wall of the collapsible tubing adjacent to the container opening.

16. The method according to claim 13, wherein the gas is withdrawn through an evacuation tube inserted through the sidewall of the container opposite to the container opening.

17. The method according to claim 13, wherein a tube assembly comprising a flushing tube and an evacuation tube is inserted into the inner space of the container.

18. The method according to claim 1, wherein the opening is closed by a lid member after the collapsible tubing has been drawn into the container.

19. The method according to claim 18, wherein the pressure within the receiver is maintained at a level of less than the ambient pressure.

20. The method according to claim 1, wherein the receiver comprises a vessel having an upwardly-directed inlet opening, and said collapsible tubing is positioned within such inlet opening.

21. The method according to claim 1, wherein the collapsible tubing is constructed from plastic film.

22. A container for hazardous powdered, particulate or liquid materials, said container having an upper wall part which is removable so as to define an opening therein and flexible, collapsible tubing having one end thereof sealingly affixed to container side wall surfaces surrounding the opening and extending beyond the container and its other end open, said tubing being arranged in a collapsed, inactive position and being extendable, the axial length of the tubing extending beyond the container being in the range of about 2 to 3.5 times the axial length of the container when extended.

23. A container for hazardous powdered, particulate or liquid materials, said container having an upper wall part which is removable so as to define an opening therein and flexible, collapsible tubing sealingly affixed to container side wall surfaces surrounding the opening and extending beyond the container, said tubing being arranged in a collapsed, inactive position and being extendable, the axial length of the tubing extending beyond the container being in the range of about 2 to 3.5 times the axial length of the container when extended, said side wall surfaces being outer surfaces and said tubing forming an annular ridge on the side wall surfaces.

24. A container for hazardous powdered, particulate or liquid materials, said container having an upper wall part which is removable so as to define an opening therein and flexible, collapsible tubing sealingly affixed to container side wall surfaces surrounding the opening and extending beyond the container, said tubing being arranged in a collapsed, inactive position and being extendable, the axial length of the tubing extending beyond the container being in the range of about 2 to 3.5 times the axial length of the container when extended, said side wall surfaces being inner surfaces and said tubing being disposed inside the container adjacent to the container opening.

* * * * *